US011508314B2

(12) United States Patent
Kim et al.

(10) Patent No.: US 11,508,314 B2
(45) Date of Patent: Nov. 22, 2022

(54) PIXEL AND DISPLAY DEVICE INCLUDING THE SAME

(71) Applicant: Samsung Display Co., Ltd., Yongin-Si (KR)

(72) Inventors: Sungyup Kim, Yongin-si (KR); Sunyoung Park, Suwon-si (KR); Tae-Ho Kim, Seoul (KR); Jonguk Bang, Hwaseong-si (KR); Min-Tak Lee, Hwaseong-si (KR); Joon Huh, Seoul (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/524,655

(22) Filed: Nov. 11, 2021

(65) Prior Publication Data

US 2022/0223112 A1 Jul. 14, 2022

(30) Foreign Application Priority Data

Jan. 8, 2021 (KR) ..... 10-2021-0002517

(51) Int. Cl.
*G09G 3/3283* (2016.01)

(52) U.S. Cl.
CPC ... *G09G 3/3283* (2013.01); *G09G 2300/0842* (2013.01); *G09G 2310/08* (2013.01); *G09G 2330/021* (2013.01)

(58) Field of Classification Search
CPC combination set(s) only.
See application file for complete search history.

(56) References Cited

FOREIGN PATENT DOCUMENTS

| | | | |
|---|---|---|---|
| KR | 10-0574089 | B1 | 4/2006 |
| KR | 10-0864882 | B1 | 10/2008 |
| KR | 10-2016-0017959 | A | 2/2016 |
| KR | 10-2016-0033957 | A | 3/2016 |
| KR | 10-2018-0011434 | A | 2/2018 |
| KR | 10-2073869 | B1 | 2/2020 |

*Primary Examiner* — Sanjiv D. Patel
(74) *Attorney, Agent, or Firm* — Innovation Counsel LLP

(57) ABSTRACT

A pixel and a display device including the pixel are disclosed. The pixel comprises a first transistor, a second transistor, a third transistor, a fourth transistor, a fifth transistor, a sixth transistor, a seventh transistor, an eighth transistor, a first capacitor, and a light emitting element. The eighth transistor includes a gate electrode configured to receive a second data voltage, a first electrode connected to a fourth node, and a second electrode configured to receive an initialization voltage. The eighth transistor adjusts a voltage level of the first capacitor based on a difference between the voltage level of the first capacitor and a level of the second data voltage.

20 Claims, 10 Drawing Sheets

PIXEL AND DISPLAY DEVICE INCLUDING THE SAME

CROSS-REFERENCE TO RELATED APPLICATION

This application claims priority under 35 USC § 119 to Korean Patent Application No. 10-2021-0002517 filed on Jan. 8, 2021 in the Korean Intellectual Property Office (KIPO), the entire disclosure of which is incorporated herein by reference.

BACKGROUND

1. Field

The present inventive concept relates to a pixel and a display device including the pixel. More particularly, the present inventive concept relates to a pixel circuit of a pixel and a display device including the pixel circuit.

2. Description of the Related Art

A pixel of an organic light emitting diode display device may include a storage capacitor configured to store a data voltage and a driving transistor configured to generate a driving current based on the data voltage. In addition, the pixel of the organic light emitting diode display device may be provided therein with a configuration for compensating for a threshold voltage of the driving transistor and initializing an anode of a light emitting element (e.g., an organic light emitting diode) in order to reduce display defects such as luminance deviation between pixels.

The pixel may be configured such that a gate electrode of a first transistor may be initialized to an initialization voltage every frame. However, when a level of the data voltage of a previous frame is lower than a level of the data voltage of a current frame, it may be unnecessary to initialize the gate electrode of the first transistor to the initialization voltage. When the gate electrode of the first transistor is initialized to the initialization voltage every frame without considering the data voltage of each frame, unnecessary power consumption of the display device may be caused. In addition, when the gate electrode of the first transistor is initialized to the initialization voltage every frame, the display device may repeat charging and discharging of the first capacitor, so that there may be a disadvantage in high-speed driving of a display panel.

SUMMARY

According to an embodiment a pixel may include a first transistor including a gate electrode connected to a first node, a first electrode connected to a second node, and a second electrode connected to a third node, a second transistor including a gate electrode configured to receive a first gate signal, a first electrode configured to receive a first data voltage, and a second electrode connected to the second node, a third transistor including a gate electrode configured to receive the first gate signal, a first electrode connected to the first node, and a second electrode connected to the third node, a fourth transistor including a gate electrode configured to receive the first gate signal, a first electrode connected to the first node, and a second electrode connected to a fourth node, a fifth transistor including a gate electrode configured to receive a first emission control signal, a first electrode configured to receive a first power supply voltage, and a second electrode connected to the second node, a sixth transistor including a gate electrode configured to receive the first emission control signal, a first electrode connected to the third node, and a second electrode connected to a fifth node, a seventh transistor including a gate electrode configured to receive a second gate signal, a first electrode configured to receive an initialization voltage, and a second electrode connected to the fifth node, an eighth transistor including a gate electrode configured to receive a second data voltage, a first electrode connected to the fourth node, and a second electrode configured to receive the initialization voltage, a first capacitor including a first electrode configured to receive the first power supply voltage and a second electrode connected to the first node, and a light emitting element including a first electrode connected to the fifth node and a second electrode configured to receive a second power supply voltage.

In an embodiment, the eighth transistor may adjust a voltage level of the first capacitor based on a difference between a level of a voltage stored in the first capacitor and a level of the second data voltage.

In an embodiment, the eighth transistor may decrease the voltage level of the first capacitor to the level of the second data voltage when the voltage stored in the first capacitor is greater than the second data voltage.

In an embodiment, the eighth transistor may increase the voltage level of the first capacitor to the level of the second data voltage when the voltage stored in the first capacitor is less than the second data voltage.

In an embodiment, the first data voltage and the second data voltage may have a same level.

In an embodiment, the first data voltage and the second data voltage may have mutually different levels.

In an embodiment, the second data voltage may be equal to a sum of the first data voltage and a threshold voltage of the eighth transistor.

In an embodiment, the pixel may further includes a ninth transistor including a gate electrode configured to receive the first gate signal, a first electrode configured to receive a data compensation voltage, and a second electrode connected to the gate electrode of the eighth transistor.

In an embodiment, the level of the second data voltage may be determined according to a voltage ratio between the first data voltage and the data compensation voltage.

In an embodiment, the second data voltage may be generated based on an over-driving data look-up table to compensate for a threshold voltage of the eighth transistor.

According to an embodiment, a display device may include a display panel including a plurality of pixels and a panel driver configured to drive the display panel. Here, each of the pixels may include a light emitting element, a switching transistor to which a data voltage is applied in response to a gate signal, a first capacitor configured to store the data voltage when the switching transistor is turned on in response to the gate signal, a driving transistor configured to allow a driving current corresponding to the data voltage stored in the first capacitor to flow to the light emitting element, and a voltage control transistor configured to receive the data voltage through a gate electrode of the voltage control transistor and to adjust a voltage level of the first capacitor based on a difference between the voltage level of the first capacitor and a level of the data voltage received through the gate electrode.

In an embodiment, the data voltage applied to the switching transistor may be a first data voltage, and the data voltage received through the gate electrode of the voltage control transistor may be a second data voltage.

In an embodiment, the voltage control transistor may decrease the voltage level of the first capacitor to a level of the second data voltage when the voltage stored in the first capacitor is greater than the second data voltage.

In an embodiment, the voltage control transistor may increase the voltage level of the first capacitor to a level of the second data voltage when the voltage stored in the first capacitor is less than the second data voltage.

In an embodiment, the first data voltage and the second data voltage may have a same level.

In an embodiment, the first data voltage and the second data voltage may have mutually different levels.

In an embodiment, the second data voltage may be equal to a sum of the first data voltage and a threshold voltage of the voltage control transistor.

In an embodiment, the display device may further include a compensation transistor including a gate electrode configured to receive the gate signal, a first electrode configured to receive a data compensation voltage, and a second electrode connected to the gate electrode of the voltage control transistor.

In an embodiment, a level of the second data voltage may be determined according to a voltage ratio between the first data voltage and the data compensation voltage.

In an embodiment, the second data voltage may be generated based on an over-driving data look-up table to compensate for a threshold voltage of the voltage control transistor.

DETAILED DESCRIPTION

Embodiments of the present inventive concept may provide a pixel that can drive a display panel at a high speed while minimizing (or reducing) unnecessary power consumption.

Embodiments of the present inventive concept may provide a display device including the pixel.

According to embodiments, a pixel and a display device including the pixel may minimize unnecessary power consumption in the pixel. In addition, the pixel and the display device including the pixel may drive a display panel at a high speed because an operation of separately initializing a gate electrode of a first transistor is omitted. As a result, the pixel and the display device including the pixel may improve display quality of the display panel.

Hereinafter, embodiments of the present disclosure will be explained in detail with reference to the accompanying drawings.

Figure 1:
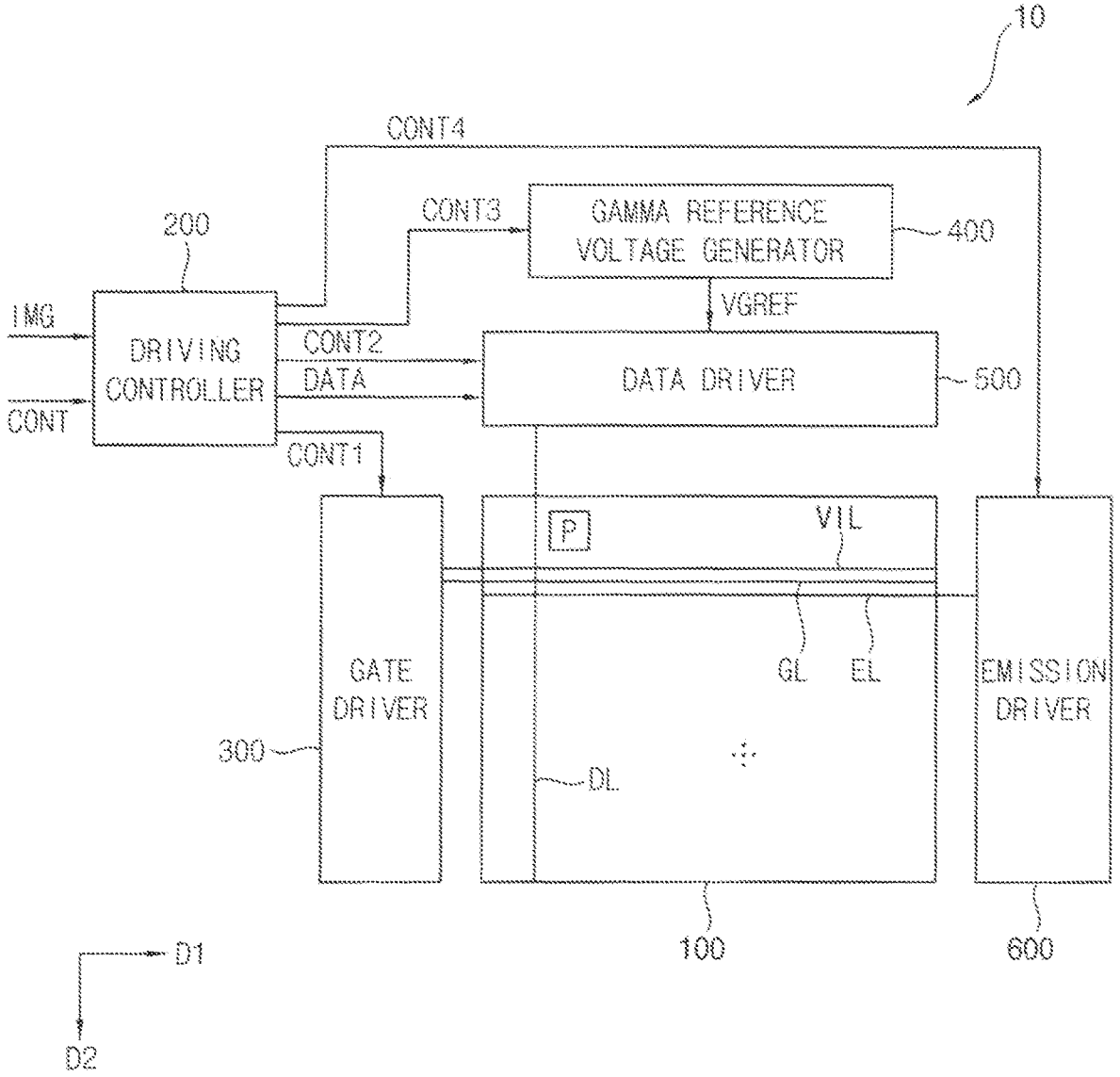
FIG. 1 is a block diagram showing a display device according to embodiments.

FIG. 1 is a block diagram showing a display device according to embodiments.

Referring to FIG. 1, a display device 10 may include a display panel 100 and a display panel driver. The display panel driver may include a driving controller 200, a gate driver 300, a gamma reference voltage generator 400, a data driver 500, and an emission driver 600.

The display panel 100 may include a display part for displaying an image and a peripheral part adjacent to the display part.

The display panel 100 may include a plurality of gate lines GL, a plurality of data lines DL, a plurality of emission control lines EL, and a plurality of pixels P electrically connected to the gate lines GL, the data lines DL, and the emission control lines EL, respectively. The gate lines GL may extend in a first direction D1, the data lines DL may extend in a second direction D2 intersecting the first direction D1, and the emission control lines EL may extend in the first direction D1.

The driving controller 200 may receive input image data IMG and an input control signal CONT from an external device (not shown). For example, the input image data IMG may include red image data, green image data, and blue image data. The input image data IMG may include white image data. The input image data IMG may include magenta image data, yellow image data, and cyan image data. The input control signal CONT may include a master clock signal and a data enable signal. The input control signal CONT may further include a vertical synchronization signal and a horizontal synchronization signal.

The driving controller 200 may generate a first control signal CONT1, a second control signal CONT2, a third control signal CONT3, a fourth control signal CONT4, and a data signal DATA based on the input image data IMG and the input control signal CONT.

The driving controller 200 may generate the first control signal CONT1 for controlling an operation of the gate driver 300 based on the input control signal CONT to output the generated first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT to output the generated second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT to output the generated third control signal CONT3 to the gamma reference voltage generator 400.

The driving controller 200 may generate the fourth control signal CONT4 for controlling an operation of the emission driver 600 based on the input control signal CONT to output the generated fourth control signal CONT4 to the emission driver 600.

The gate driver 300 may generate gate signals for driving the gate lines GL in response to the first control signal CONT1 received from the driving controller 200. The gate driver 300 may output the gate signals to the gate lines GL.

In an embodiment, the gate driver 300 may generate initialization signals for driving initialization lines VIL in response to the first control signal CONT1 received from the driving controller 200. The gate driver 300 may output the initialization signals to the initialization lines VIL.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

For example, the gamma reference voltage generator 400 may be disposed in the driving controller 200 or in the data driver 500.

The data driver 500 may receive the second control signal CONT2 and the data signal DATA from the driving controller 200, and receive the gamma reference voltage VGREF from the gamma reference voltage generator 400. The data driver 500 may convert the data signal DATA into an analog data voltage VDATA by using the gamma reference voltage VGREF. The data driver 500 may output the data voltage VDATA to the data line DL.

The emission driver 600 may generate emission control signals for driving the emission control lines EL in response to the fourth control signal CONT4 received from the driving controller 200. The emission driver 600 may output the emission control signals to the emission control lines EL.

Figure 2:
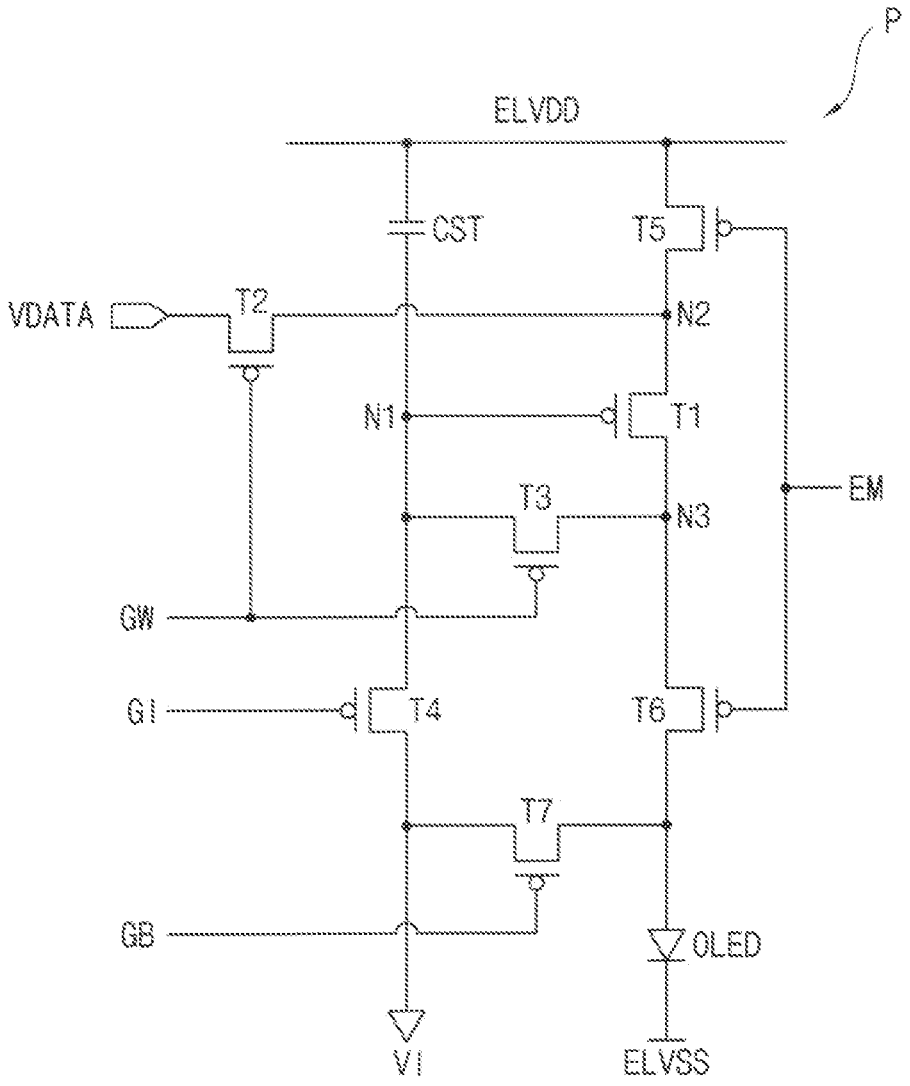
FIG. 2 is a circuit diagram showing an embodiment of a pixel according to the related art.
Figure 3:
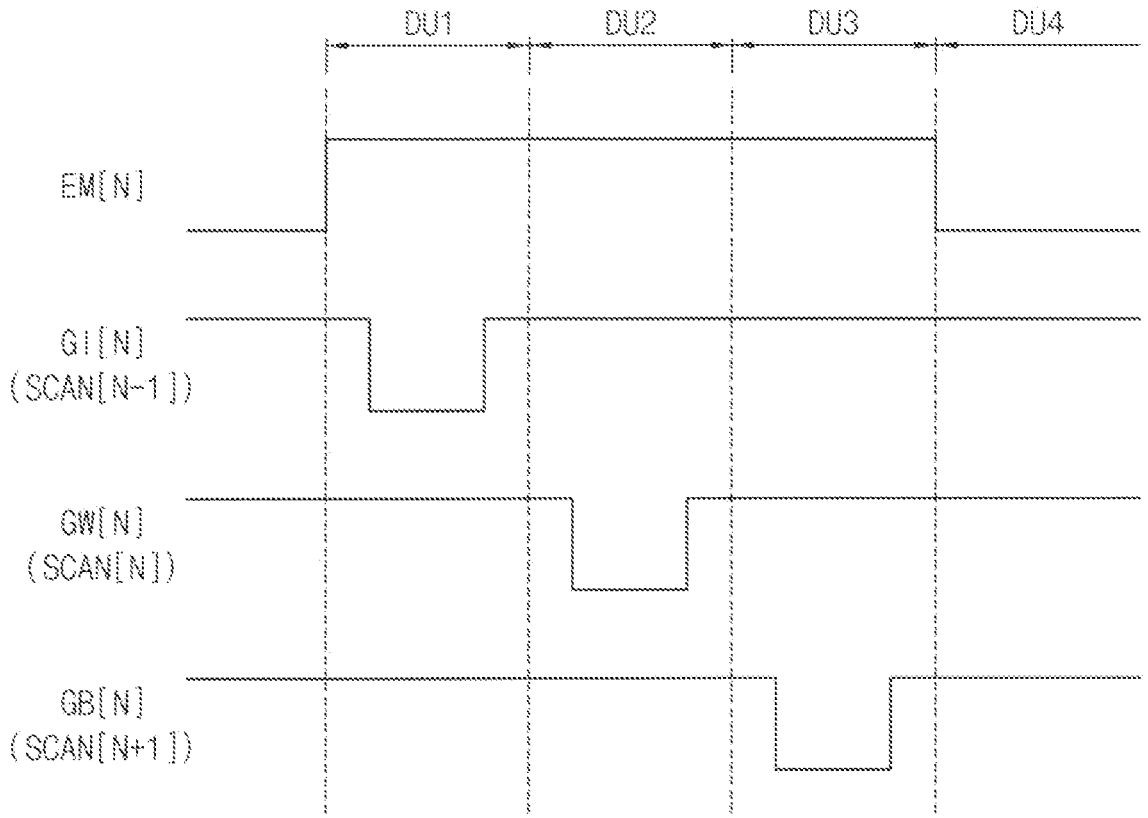
FIG. 3 is a timing diagram showing input signals applied to the pixel of FIG. 2.

FIG. 2 is a circuit diagram showing an embodiment of a pixel according to the related art, and FIG. 3 is a timing diagram showing input signals applied to the pixel of FIG. 2.

Referring to FIGS. 1 to 3, a conventional display panel 100 may include a plurality of pixels P, and each of the pixels P may include a light emitting element OLED. For example, the light emitting element OLED may be an organic light emitting diode. A conventional pixel P having a 7T1C (seven transistor-one capacitor) structure may include a first transistor T1, a second transistor T2, a third transistor T3, a fourth transistor T4, a fifth transistor T5, a sixth transistor T6, a seventh transistor T7, and a first capacitor CST.

The conventional pixel P having the 7T1C structure may include a first period DU1 during which a gate electrode of the first transistor T1 is initialized, a second period DU2 during which the data voltage VDATA for which a threshold voltage is compensated is written, a third period DU3 during which a first electrode of the light emitting element OLED is initialized, and a fourth period DU4 during which the light emitting element OLED emits light. The pixel P may receive a first gate signal GW, a data initialization gate signal GI, a second gate signal GB, the data voltage VDATA, and the emission control signal EM to allow the light emitting element OLED to emit the light according to a level of the data voltage VDATA so that the image may be displayed. In detail, during the first period DU1, the fourth transistor T4 may be turned on, and an initialization voltage VI may be applied to a first node N1, so that the gate electrode of the first transistor T1 may be initialized. During the second period DU2, the second transistor T2 and the third transistor T3 may be turned on. As the second transistor T2 is turned on, the data voltage VDATA may be supplied to the first node N1, and as the third transistor T3 is turned on, the first transistor T1 may be diode-coupled. Therefore, the data voltage VDATA for which the threshold voltage of the first transistor T1 is compensated may be stored in the first capacitor CST. During the third period DU3, the seventh transistor T7 may be turned on, and the initialization voltage VI may be applied to the first electrode of the light emitting element OLED so that the first electrode of the light emitting element OLED may be initialized. During the fourth period DU4, the fifth transistor T5 and the sixth transistor T6 may be turned on so that a driving current generated by the first transistor T1 may flow to the light emitting element OLED. Meanwhile, during the first period DUL the fourth transistor T4 may use the data initialization gate signal GI as a gate voltage, so that the gate electrode of the first transistor T1 may be initialized to the initialization voltage VI every frame.

However, when a level of the data voltage VDATA of a previous frame is lower than a level of the data voltage VDATA of a current frame, it may be unnecessary to initialize the gate electrode of the first transistor T1 to the initialization voltage VI, which is addressed by the present inventive concept. In other words, when the gate electrode of the first transistor T1 is initialized to the initialization voltage VI every frame without considering the data voltage VDATA of each frame, unnecessary power consumption of the display device may be caused. In addition, when the gate electrode of the first transistor T1 is initialized to the initialization voltage VI every frame, the display device may repeat charging and discharging of the first capacitor CST, so that there may be a disadvantage in high-speed driving of the display panel 100.

The pixel P of the display device according to embodiments may be obtained by changing the conventional pixel P having the 7T1C structure to receive the first gate signal GW through a gate electrode of the fourth transistor T4, connect an eighth transistor T8 between a second electrode of the fourth transistor T4 and a fourth node N4 to which the initialization voltage is applied, and apply the data voltage VDATA to a gate electrode of the eighth transistor T8, so that the unnecessary power consumption may be reduced, and the display panel 100 may be driven at a high speed.

Figure 4:
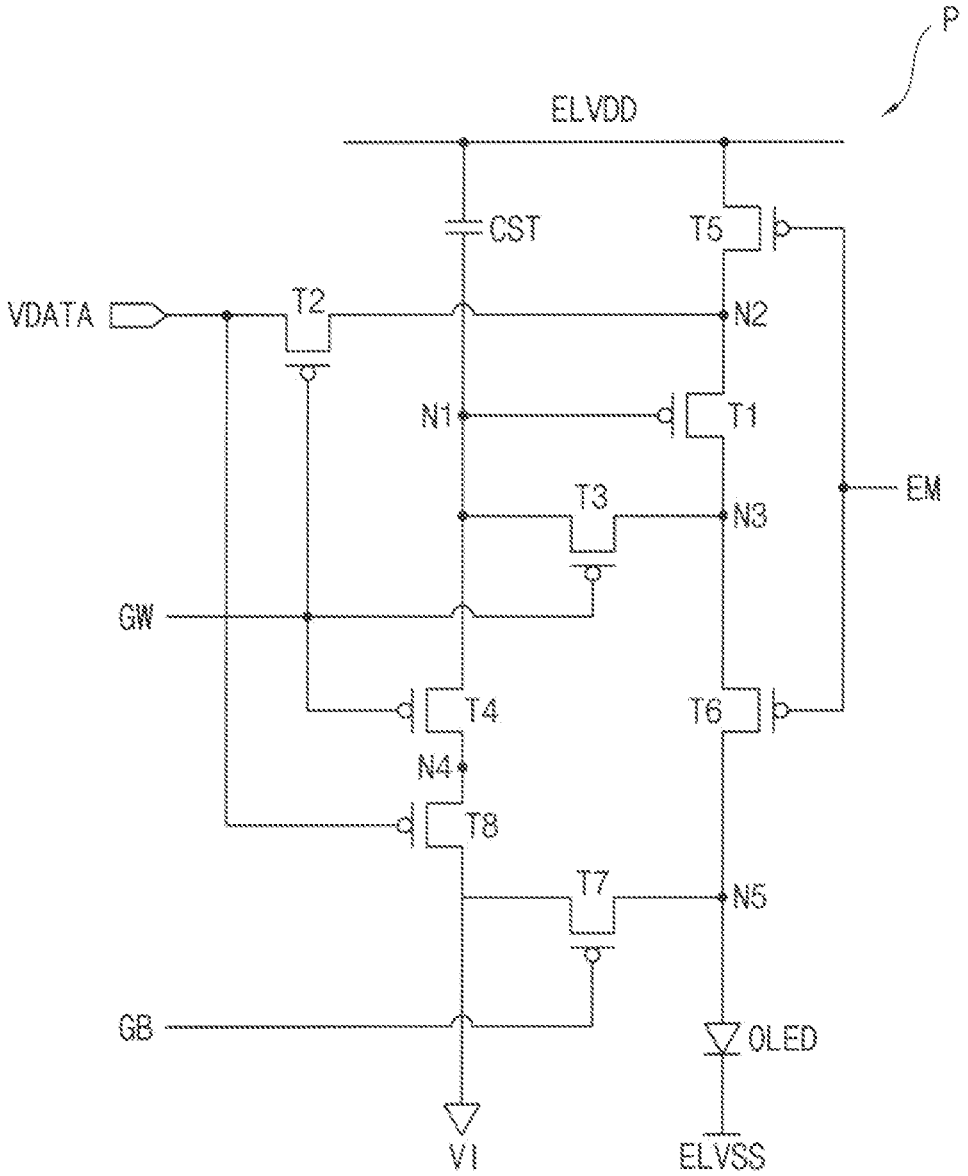
FIG. 4 is a circuit diagram showing an embodiment of a pixel of a display panel in FIG. 1.
Figure 5:
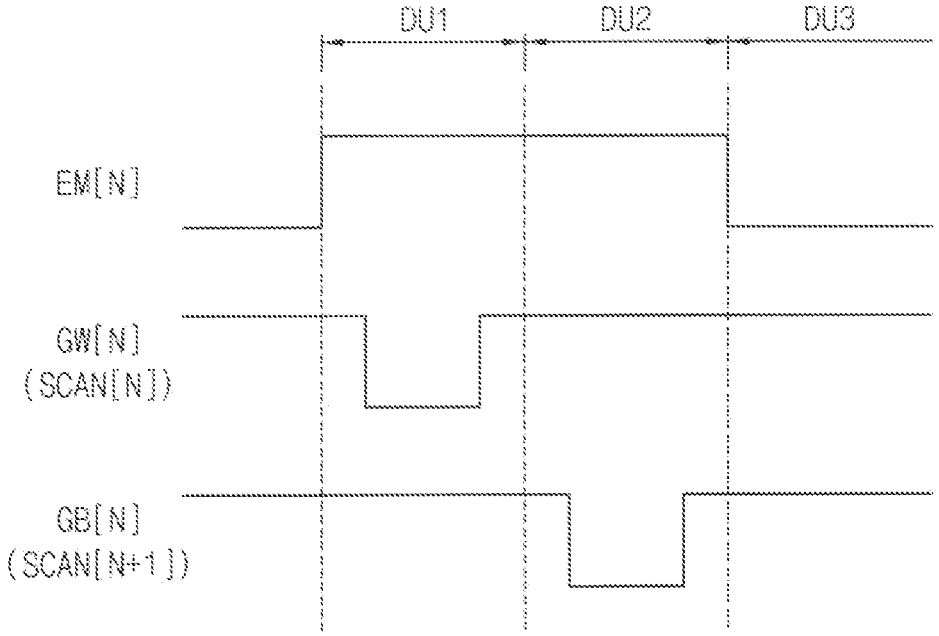
FIG. 5 is a timing diagram showing input signals applied to the pixel of FIG. 4.

FIG. 4 is a circuit diagram showing an embodiment of a pixel of a display panel in FIG. 1, and FIG. 5 is a timing diagram showing input signals applied to the pixel of FIG. 4.

Referring to FIG. 4, the pixel P according to an embodiment may include: a first transistor T1 including a gate electrode connected to a first node N1, a first electrode connected to a second node N2, and a second electrode connected to a third node N3; a second transistor T2 including a gate electrode configured to receive a first gate signal GW, a first electrode configured to receive a first data voltage VDATA, and a second electrode connected to the second node N2; a third transistor T3 including a gate electrode configured to receive the first gate signal GW, a first electrode connected to the first node N1, and a second electrode connected to the third node N3; a fourth transistor T4 including a gate electrode configured to receive the first gate signal GW, a first electrode connected to the first node N1, and a second electrode connected to a fourth node N4; a fifth transistor T5 including a gate electrode configured to receive a first emission control signal EM, a first electrode configured to receive a first power supply voltage ELVDD, and a second electrode connected to the second node N2; a sixth transistor T6 including a gate electrode configured to receive the first emission control signal EM, a first electrode connected to the third node N3, and a second electrode connected to a fifth node N5; a seventh transistor T7 including a gate electrode configured to receive a second gate signal GB, a first electrode configured to receive an initialization voltage VI, and a second electrode connected to the fifth node N5; an eighth transistor T8 including a gate electrode configured to receive a second data voltage VDATA, a first electrode connected to the fourth node N4, and a second electrode configured to receive the initialization voltage VI; a first capacitor including a first electrode configured to receive the first power supply voltage ELVDD, and a second electrode connected to the first node N1; and a light emitting element including a first electrode connected to the fifth node N5, and a second electrode configured to receive a second power supply voltage ELVSS. The pixel P may receive the first gate signal GW, the second gate signal GB, the data voltage VDATA, and the emission control signal EM to allow the light emitting element OLED to emit light according to a level of the data voltage VDATA so that the image may be displayed.

The first transistor T1 may include the gate electrode connected to the first node, the first electrode connected to the second node, and the second electrode connected to the third node. The first transistor T1 may generate a driving current in response to the data voltage VDATA. The first transistor T1 may be connected between the second node N2 and the third node N3, and the gate electrode of the first transistor T1 may be connected to the first node N1 to control the driving current. The first transistor T1 may generate the driving current in response to the data voltage VDATA stored in the first capacitor CST. When the fifth transistor T5 and the sixth transistor T6 are turned on, the first transistor T1 may provide the driving current to an anode electrode of the light emitting element OLED.

The second transistor T2 may include the gate electrode configured to receive the first gate signal GW, the first electrode configured to receive the first data voltage VDATA, and the second electrode connected to the second node N2. The second transistor T2 may provide the first data voltage VDATA to the second node N2 in response to the first gate signal GW. The second transistor T2 may be connected between the data line DL and the second node N2, and the gate electrode of the second transistor T2 may be connected to a first gate line. When the second transistor T2 is turned on, the first data voltage VDATA supplied through the data line DL may be provided to the second node N2. The second transistor T2 may be turned on in a first period DU1 (FIG. 5) during which the first data voltage VDATA is written.

The third transistor T3 may include the gate electrode configured to receive the first gate signal GW, the first electrode connected to the first node N1, and the second electrode connected to the third node N3. The third transistor T3 may provide a voltage of the first node N1 to the third node N3 in response to the first gate signal GW. The third transistor T3 may be connected between the first node N1 and the third node N3, and the gate electrode of the third transistor T3 may be connected to the first gate line. The third transistor T3 may be turned on in the first period DU1 during which data is written.

The fourth transistor T4 may include the gate electrode configured to receive the first gate signal GW, the first electrode connected to the first node N1, and the second electrode connected to the fourth node N4. The fourth transistor T4 may provide a voltage of the fourth node N4 to the first node N1 in response to the first gate signal GW. The fourth transistor T4 may be connected between the first node N1 and the fourth node N4, and the gate electrode of the fourth transistor T4 may be connected to the first gate line. The fourth transistor T4 may be turned on in the first period DU1 in which the data is written.

The fifth transistor T5 may include the gate electrode configured to receive the first emission control signal EM, the first electrode configured to receive the first power supply voltage ELVDD, and the second electrode connected to the second node N2. The fifth transistor T5 may provide the first power supply voltage ELVDD to the second node N2 in response to the first emission control signal EM. The fifth transistor T5 may be connected between a first power supply voltage (ELVDD) supply line and the second node N2, and the gate electrode of the fifth transistor T5 may be connected to a first emission control line ELL When the fifth transistor T5 is turned on, the first power supply voltage ELVDD may be provided to the second node N2. The fifth transistor T5 may be turned on in a third period DU3 during which the light emitting element OLED emits the light.

The sixth transistor T6 may include the gate electrode configured to receive the first emission control signal EM, the first electrode connected to the third node N3, and the second electrode connected to the fifth node N5. The sixth transistor T6 may provide a voltage of the third node N3 to the fifth node N5 in response to the first emission control signal EM. The sixth transistor T6 may be connected between the third node N3 and the fifth node N5, and the gate electrode of the sixth transistor T6 may be connected to the first emission control line ELL When the sixth transistor T6 is turned on, the voltage of the third node may be applied to the fifth node N5. The sixth transistor T6 may be turned on in the third period DU3 during which the light emitting element OLED emits the light.

The seventh transistor T7 may include the gate electrode configured to receive the second gate signal GB, the first electrode configured to receive the initialization voltage VI, and the second electrode connected to the fifth node N5. The seventh transistor T7 may provide the initialization voltage VI to the fifth node N5 in response to the second gate signal GB. The seventh transistor T7 may be connected between an initialization voltage supply line and the fifth node N5, and the gate electrode of the seventh transistor T7 may be connected to a second gate line. When the seventh transistor T7 is turned on, the fifth node N5 may be initialized to the initialization voltage VI. The seventh transistor T7 may be turned on in a second period DU2 during which the first electrode of the light emitting element OLED is initialized.

The eighth transistor T8 may include the gate electrode configured to receive the second data voltage VDATA, the first electrode connected to the fourth node N4, and the second electrode configured to receive the initialization voltage VI. The eighth transistor T8 may provide the initialization voltage VI to the fourth node N4 in response to the second data voltage VDATA. The eighth transistor T8 may be connected between the fourth node N4 and the initialization voltage supply line, and the gate electrode of the eighth transistor T8 may be connected to the data line DL. When the eighth transistor T8 is turned on, the initialization voltage VI may be provided to the fourth node N4.

The first capacitor CST may include the first electrode configured to receive the first power supply voltage ELVDD, and the second electrode connected to the first node N1. The first capacitor CST may be connected between the first power supply voltage supply line and the first node N1. The first capacitor CST may store the data voltage VDATA supplied through the first node N1 during the second period.

The light emitting element OLED may include the first electrode connected to the fifth node N5, and the second electrode configured to receive the second power supply voltage ELVSS. The light emitting element OLED may be connected between the fifth node N5 and a second power supply voltage supply line. During the second period, the initialization voltage VI may be provided to the fifth node N5 to initialize the first electrode of the light emitting element OLED. The light emitting element OLED may emit the light based on the driving current during the third period DU3.

The first to eighth transistors T1 to T8 may be turned on in response to a voltage corresponding to a first logic level, and turned off in response to a voltage corresponding to a second logic level. As shown in FIG. 4, when the first to eighth transistors T1 to T8 are implemented as P-channel metal oxide semiconductor (PMOS) transistors, the first logic level may be a low level (e.g., about 0 V), and the second logic level may be a high level (e.g., about 10V).

Although the pixel P in which the first to eighth transistors T1 to T8 are implemented as PMOS transistors has been shown in FIG. 4, the first to eighth transistors T1 to T8 are not limited thereto. For example, each of the first to eighth transistors T1 to T8 may be implemented as an N-channel metal oxide semiconductor (NMOS) transistor. When the first to eighth transistors T1 to T8 are implemented as NMOS transistors, the first logic level may be a high level (e.g., about 10 V), and the second logic level may be a low level (e.g., about 0 V). In this case, alternatively, each of the first to eighth transistors T1 to T8 may be implemented as a low-temperature polycrystalline silicon (LTPS) thin film transistor, an oxide thin film transistor, or a low-temperature polycrystalline oxide (LTPO) thin film transistor.

As shown in FIG. 5, a threshold voltage (|VTH|) of the first transistor T1 may be compensated for by the first gate signal GW during the first period DUL and the data voltage VDATA for which the threshold voltage (|VTH|) is compensated may be written to the first node N1. During the second period DU2, the anode electrode of the light emitting element OLED may be initialized by the second gate signal GB. During the third period DU3, the light emitting element OLED may emit the light by the emission control signal EM, so that the display panel 100 may display the image. During the first period DU1, the first gate signal GW may have an activation level. For example, the activation level of the first gate signal GW may be a low level. When the first gate signal GW has the activation level, the second transistor T2, the third transistor T3, and the fourth transistor T4 may be turned on. The first gate signal of a current stage (GW[N]) may be a scan signal of the current stage. Along a path formed by the turned-on first to third transistors T1, T2, and T3, a voltage obtained by subtracting an absolute value of the threshold voltage (|VTH|) of the first transistor T1 from the data voltage VDATA may be set to the first node N1. During the second period DU2, the second gate signal GB may have an activation level. For example, the activation level of the second gate signal GB may be a low level. When the second gate signal GB has the activation level, the seventh transistor T7 may be turned on, so that the initialization voltage VI may be applied to the anode electrode of the light emitting element OLED. The second gate signal of the current stage (GB[N]) may be a scan signal of a next stage (SCAN[N+1]). During the third period DU3, the emission control signal EM may have an activation level. For example, the activation level of the emission control signal EM may be a low level. When the emission control signal EM has the activation level, the fifth transistor T5 and the sixth transistor T6 may be turned on. In addition, the first transistor T1 may be turned on by the data voltage VDATA. The driving current may flow in order of the fifth transistor T5, the first transistor T1, and the sixth transistor T6 to drive the light emitting element OLED. An intensity of the driving current may be determined by the level of the data voltage VDATA. A luminance of the light emitting element OLED may be determined by the intensity of the driving current.

In an embodiment, the eighth transistor T8 may adjust a voltage level of the first capacitor based on a difference between a level of a voltage stored in the first capacitor and a level of the second data voltage VDATA. As shown in FIG. 4, the first data voltage VDATA and the second data voltage VDATA may have the same level. In other words, the second data voltage VDATA may be connected to the first data voltage VDATA to have a constant level (e.g., VDATA). In detail, when the voltage stored in the first capacitor is greater than the first data voltage VDATA, the eighth transistor T8 may decrease the voltage level of the first capacitor to a level of the first data voltage VDATA. In addition, when the voltage stored in the first capacitor is less than the first data voltage VDATA, the eighth transistor T8 may increase the voltage level of the first capacitor to the level of the first data voltage VDATA.

For example, when the voltage stored in the first capacitor is greater than the first data voltage VDATA, the gate electrodes of the second transistor T2 and the fourth transistor T4 may be turned on by the first gate signal. In addition, the first data voltage VDATA may be applied to the gate electrode of the eighth transistor T8. At this point, since the first data voltage VDATA is less than the voltage stored in the first capacitor, the eighth transistor T8 may be turned on. When the eighth transistor T8 is turned on, the initialization voltage VI may be provided to the fourth node N4. In this case, the voltage stored in the first capacitor may be discharged until the voltage stored in the first capacitor becomes equal to the level of the first data voltage VDATA. When the voltage stored in the first capacitor is equal to the level of the first data voltage VDATA, the gate electrode of the eighth transistor T8 may be turned off.

For another example, when the voltage stored in the first capacitor is less than the first data voltage VDATA, the gate electrodes of the second transistor T2 and the fourth transistor T4 may be turned on by the first gate signal. In addition, the first data voltage VDATA may be applied to the gate electrode of the eighth transistor T8. At this point, since the first data voltage VDATA is greater than the voltage stored in the first capacitor, the eighth transistor T8 may be turned off. When the eighth transistor T8 is turned off, the first data voltage VDATA may be provided to the first node N1. In this case, the voltage stored in the first capacitor may be charged until the voltage stored in the first capacitor becomes equal to the level of the first data voltage VDATA.

According to the pixel P, the first capacitor may be charged or discharged to a level of the data voltage VDATA required in a current frame by using the eighth transistor T8 that is configured to receive the data voltage VDATA through the gate electrode of the eighth transistor T8. In this case, since the pixel P is configured such that the gate electrode of the first transistor T1 is not initialized to the initialization voltage VI every frame, the unnecessary power consumption in the pixel P may be minimized. In addition, since the pixel P is configured such that an operation of separately initializing the gate electrode of the first transistor T1 is omitted, the display panel 100 may be driven at a high speed.

Figure 6A:
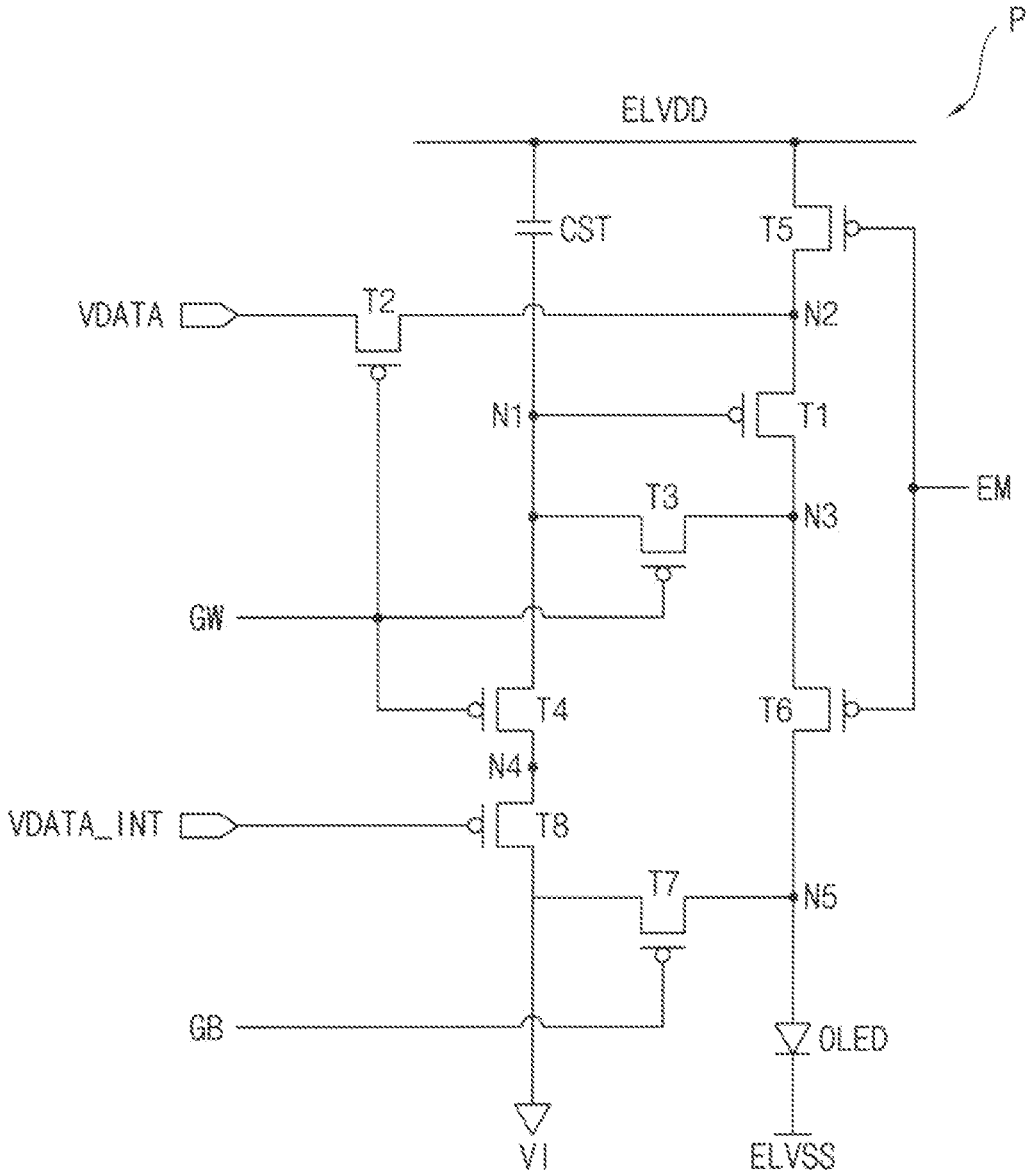
FIG. 6A is a circuit diagram showing another embodiment of a pixel of a display panel in FIG. 1.
Figure 6B:
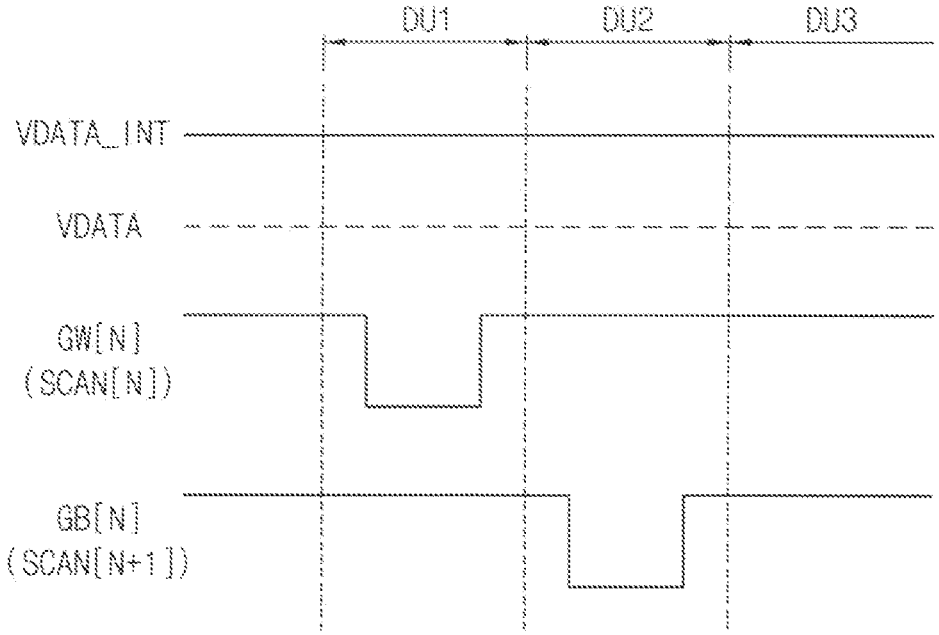
FIG. 6B is a timing diagram showing a data voltage and input signals applied to the pixel of FIG. 6A.

FIG. 6A is a circuit diagram showing another embodiment of a pixel of a display panel in FIG. 1, and FIG. 6B is a timing diagram showing a data voltage and input signals applied to the pixel of FIG. 6A.

Referring to FIGS. 6A and 6B, the eighth transistor T8 may adjust the voltage level of the first capacitor based on a difference between the level of the voltage stored in the first capacitor and a level of a second data voltage VDATA_INT. As shown in FIG. 6A, the first data voltage VDATA and the second data voltage VDATA_INT may have mutually different levels. In other words, the second data voltage VDATA_INT may be applied into the pixel P through a data line that is separate from the data line of the first data voltage VDATA. In an embodiment, the second data voltage VDATA_INT applied to the gate electrode of the eighth transistor T8 may be equal to the sum of the first data voltage VDATA and a threshold voltage of the eighth transistor T8. As shown in FIG. 6B, the level of the second data voltage VDATA_INT may be greater than the level of the first data voltage VDATA. In this case, the level of the second data voltage VDATA_INT may be the sum of the first data voltage VDATA and the threshold voltage of the eighth transistor T8. In other words, a difference between the second data voltage VDATA_INT and the first data voltage VDATA may be the threshold voltage of the eighth transistor T8. In detail, when the voltage stored in the first capacitor is greater than the second data voltage VDATA_INT, the eighth transistor T8 may decrease the voltage level of the first capacitor to the level of the second data voltage VDATA_INT. In addition, when the voltage stored in the first capacitor is less than the second data voltage VDATA_INT, the eighth transistor T8 may increase the voltage level of the first capacitor to the level of the second data voltage VDATA_INT.

For example, when the voltage stored in the first capacitor is greater than the second data voltage VDATA_INT, the gate electrodes of the second transistor T2 and the fourth transistor T4 may be turned on by the first gate signal. In addition, the second data voltage VDATA_INT may be applied to the gate electrode of the eighth transistor T8. At this point, since the second data voltage VDATA_INT is less than the voltage stored in the first capacitor, the eighth transistor T8 may be turned on. When the eighth transistor T8 is turned on, the initialization voltage VI may be provided to the fourth node N4. In this case, the voltage stored in the first capacitor may be discharged until the voltage stored in the first capacitor becomes equal to the level of the second data voltage VDATA_INT. When the voltage stored in the first capacitor is equal to the level of the second data voltage VDATA_INT, the gate electrode of the eighth transistor T8 may be turned off. For another example, when the voltage stored in the first capacitor is less than the second data voltage VDATA_INT, the gate electrodes of the second transistor T2 and the fourth transistor T4 may be turned on by the first gate signal. In addition, the second data voltage VDATA_INT may be applied to the gate electrode of the eighth transistor T8. At this point, since the second data voltage VDATA_INT is greater than the voltage stored in the first capacitor, the eighth transistor T8 may be turned off. When the eighth transistor T8 is turned off, the second data voltage VDATA_INT may be provided to the first node N1. In this case, the voltage stored in the first capacitor may be charged until the voltage stored in the first capacitor becomes equal to the level of the second data voltage VDATA_INT. In this case, since the pixel P is configured such that the gate electrode of the first transistor T1 is not initialized to the initialization voltage VI every frame, the unnecessary power consumption in the pixel P may be minimized. In addition, since the pixel P is configured such that an operation of separately initializing the gate electrode of the first transistor T1 is omitted, the display panel 100 may be driven at a high speed. In particular, since the pixel P is configured such that the second data voltage VDATA_INT for which the threshold voltage of the eighth transistor T8 is compensated is applied to the gate electrode of the first transistor T1, noise generation caused by the threshold voltage of the eighth transistor T8 may be prevented. Therefore, according to the pixel P, reliability of display quality of the display panel 100 may be improved.

Figure 7:
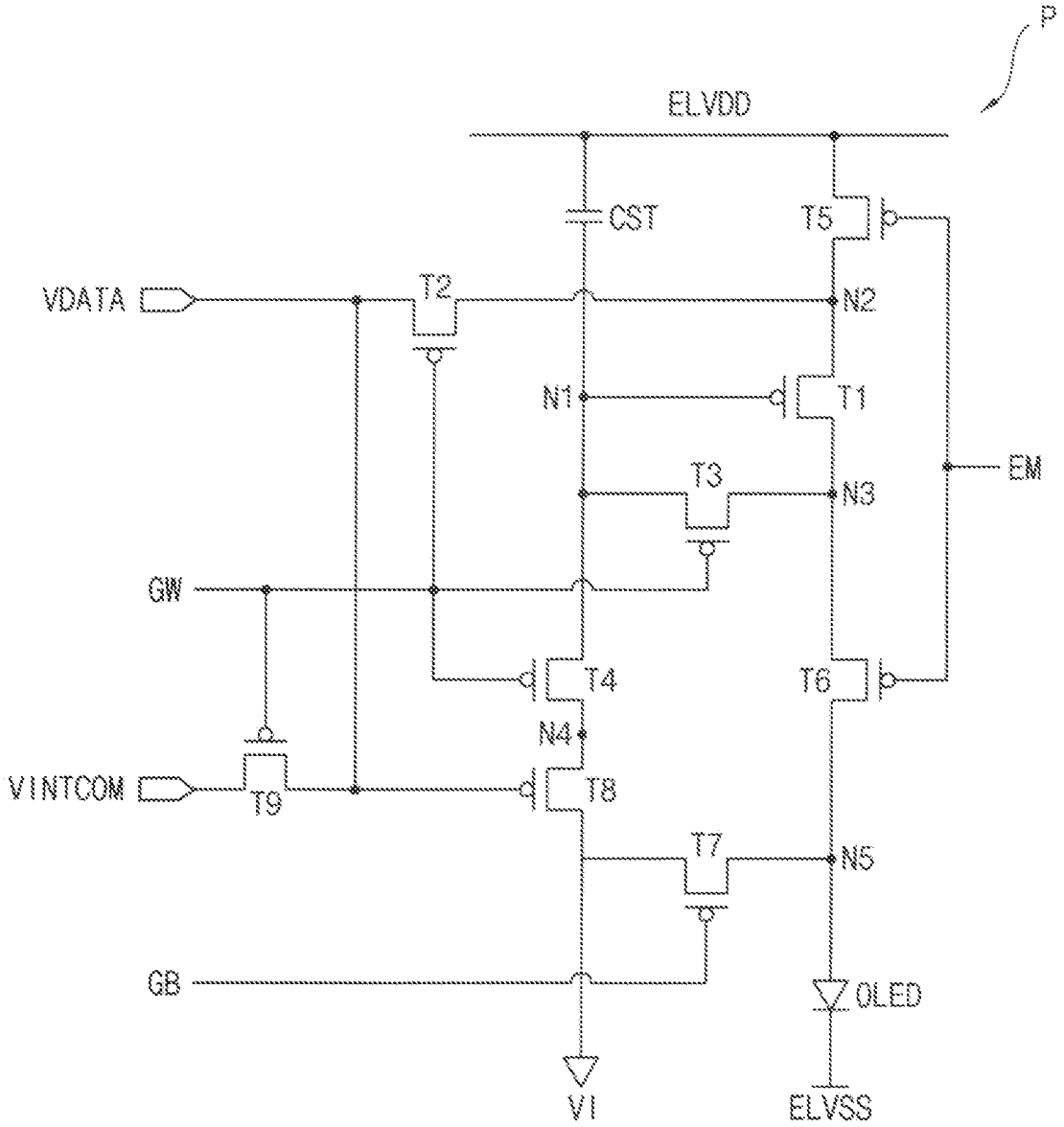
FIG. 7 is a circuit diagram showing still another embodiment of a pixel of a display panel in FIG. 1.

FIG. 7 is a circuit diagram showing still another embodiment of a pixel of a display panel in FIG. 1.

Referring to FIG. 7, the pixel P may further include a ninth transistor T9 including a gate electrode configured to receive the first gate signal, a first electrode configured to receive a data compensation voltage VINTCOM, and a second electrode connected to the gate electrode of the eighth transistor T8. In this case, the second data voltage VDATA may be adjusted based on the data compensation voltage VINTCOM. In detail, the ninth transistor T9 may apply the data compensation voltage VINTCOM to the gate electrode of the eighth transistor T8 in response to the first gate signal. In an embodiment, the level of the second data voltage VDATA may be determined according to a voltage ratio between the first data voltage VDATA and the data compensation voltage VINTCOM. The voltage ratio between the first data voltage VDATA and the data compensation voltage VINTCOM may be a ratio set according to a user input. The voltage ratio between the first data voltage VDATA and the data compensation voltage VINTCOM may be adjusted such that the second data voltage VDATA may compensate for the threshold voltage of the eighth transistor T8. For example, the level of the second data voltage VDATA may be determined as an optimal data voltage (VDATA) level for minimizing the noise generation caused by the threshold voltage of the eighth transistor T8 based on the data compensation voltage VINTCOM. Accordingly, the pixel P may be configured such that the second data voltage VDATA for which the threshold voltage of the eighth transistor T8 is compensated is applied to the gate electrode of the first transistor T1, so that the noise generation caused by the threshold voltage of the eighth transistor T8 may be prevented.

Figure 8A:
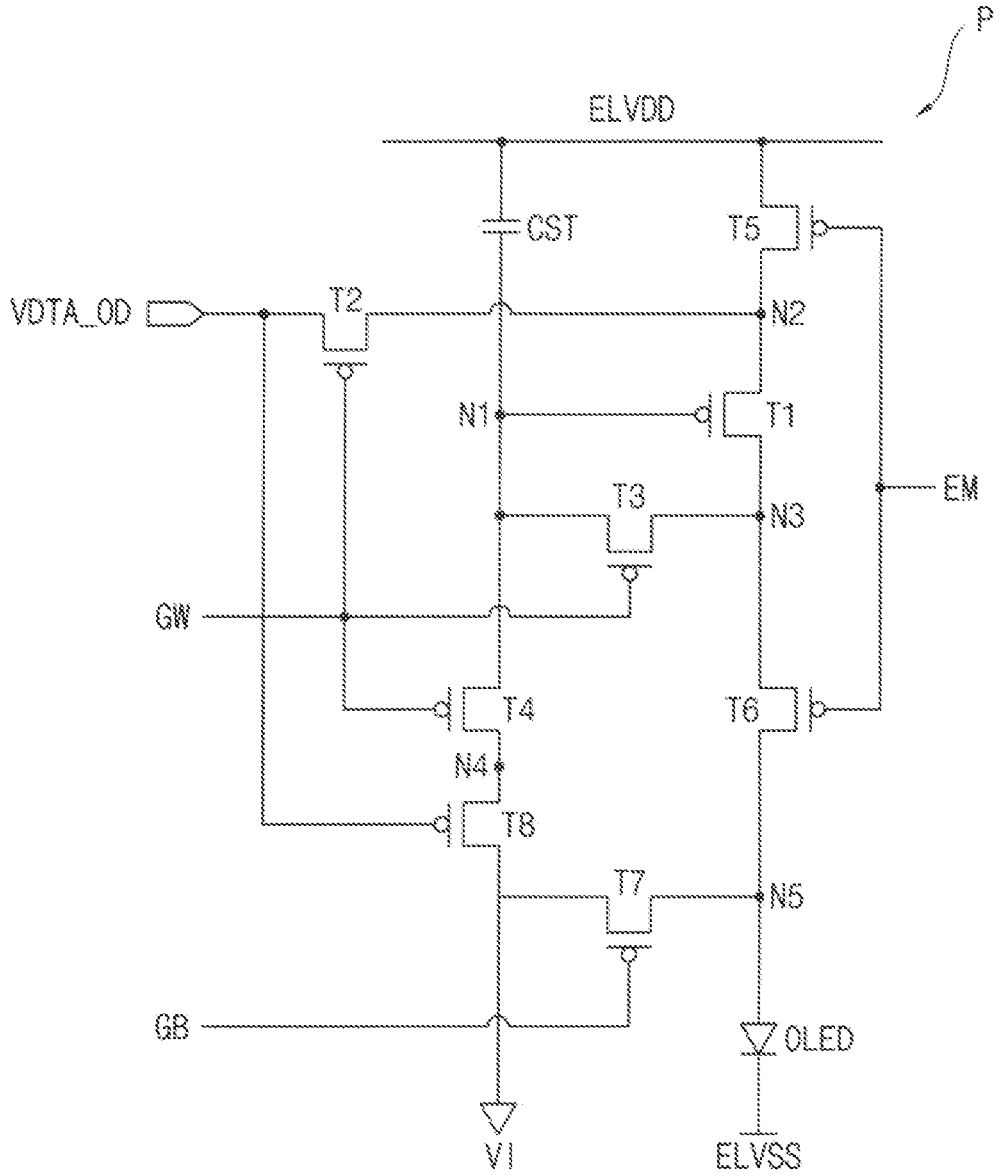
FIG. 8A is a circuit diagram showing still another embodiment of a pixel of a display panel in FIG. 1.
Figure 8B:
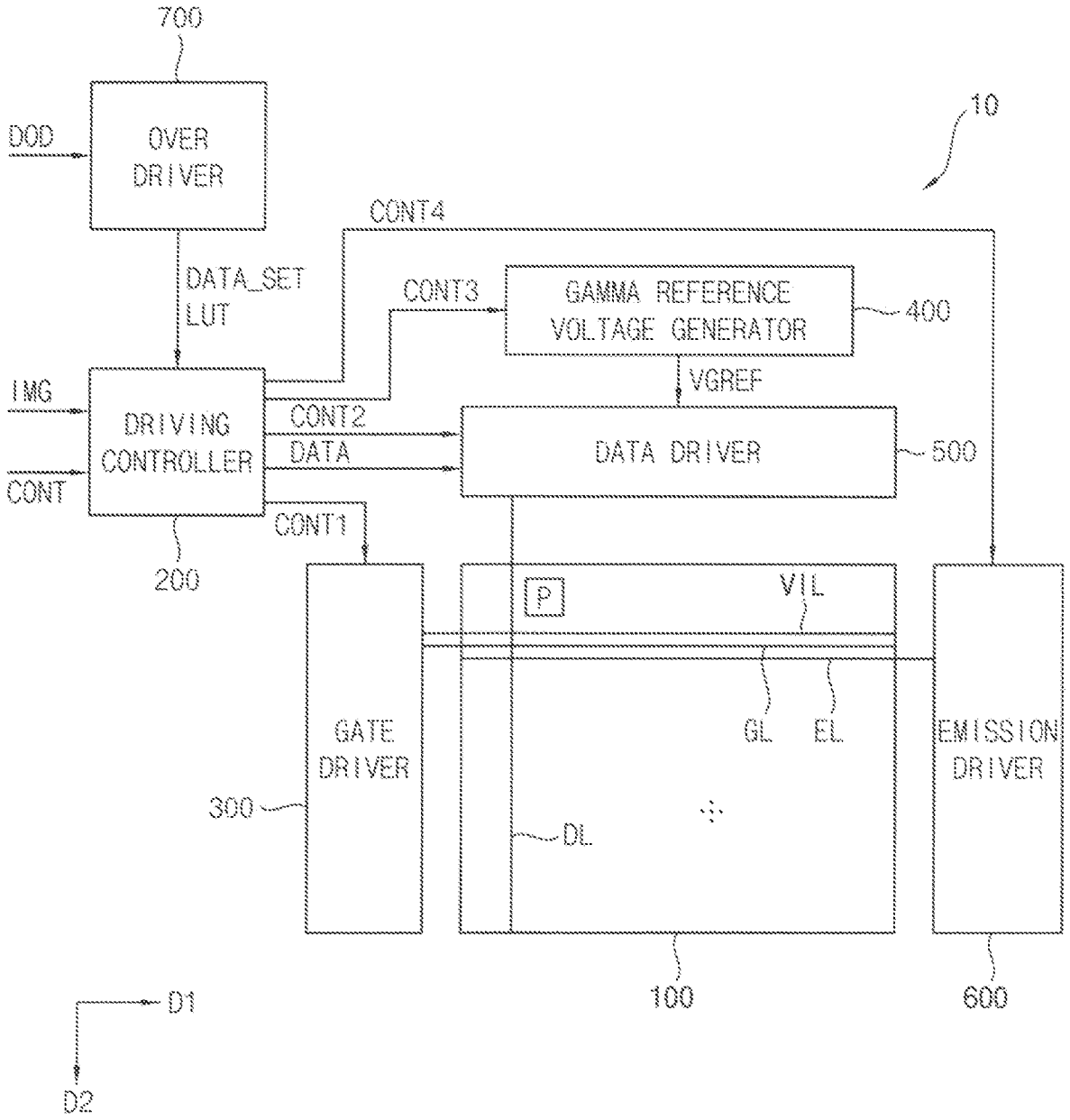
FIG. 8B is a block diagram showing an embodiment of a display device including the pixel of FIG. 8A.

FIG. 8A is a circuit diagram showing still another embodiment of a pixel of a display panel in FIG. 1, and FIG. 8B is a block diagram showing an embodiment of a display device including the pixel of FIG. 8A.

Referring to FIGS. 8A and 8B, the eighth transistor T8 may adjust the voltage level of the first capacitor based on a difference between the level of the voltage stored in the first capacitor and a level of a second data voltage VDATA_OD. As shown in FIG. 8A, the first data voltage and the second data voltage may have the same level. In other words, the second data voltage may be connected to the first data voltage to have a constant level (e.g., VDATA_OD). As shown in FIG. 8B, the display device may further include an over-driver 700. In an embodiment, the second data voltage VDATA_OD may be generated based on an over-driving data look-up table to compensate for the threshold voltage of the eighth transistor T8.

The over-driver 700 may select over-driving data DOD from an over-driving setting pattern moving in one direction, generate a reference line based on a polynomial constructed based on the over-driving data DOD, and generate an over-driving data (DOD) look-up table LUT while moving the reference line. The over-driver 700 may generate the over-driving setting pattern, and supply over-driving image data DATA_SET corresponding to the over-driving setting pattern to the driving controller 200. The over-driver 700 may receive the over-driving data DOD for canceling the threshold voltage of the eighth transistor T8, and generate the over-driving data look-up table LUT based on the over-driving data. The driving controller 200 may receive the over-driving data look-up table LUT from the over-driver 700. The driving controller 200 may perform over-driving on the input image data IMG through dynamic capacitance compensation (DCC) by using the over-driving data look-up table LUT to supply the data signal DATA to the data driver 500.

In detail, when the voltage stored in the first capacitor is greater than the first data voltage VDATA_OD, the eighth transistor T8 may decrease the voltage level of the first capacitor to a level of the first data voltage VDATA_OD. In addition, when the voltage stored in the first capacitor is less than the first data voltage VDATA_OD, the eighth transistor T8 may increase the voltage level of the first capacitor to the level of the first data voltage VDATA_OD. For example, when the voltage stored in the first capacitor is greater than the first data voltage VDATA_OD, the gate electrodes of the second transistor T2 and the fourth transistor T4 may be turned on by the first gate signal. In addition, the first data voltage VDATA_OD may be applied to the gate electrode of the eighth transistor T8. At this point, since the first data voltage VDATA_OD is less than the voltage stored in the first capacitor, the eighth transistor T8 may be turned on. When the eighth transistor T8 is turned on, the initialization voltage VI may be provided to the fourth node N4. In this case, the voltage stored in the first capacitor may be discharged until the voltage stored in the first capacitor becomes equal to the level of the first data voltage VDATA_OD. When the voltage stored in the first capacitor is equal to the level of the first data voltage VDATA_OD, the gate electrode of the eighth transistor T8 may be turned off. For another example, when the voltage stored in the first capacitor is less than the first data voltage VDATA_OD, the gate electrodes of the second transistor T2 and the fourth transistor T4 may be turned on by the first gate signal. In addition, the first data voltage VDATA_OD may be applied to the gate electrode of the eighth transistor T8. At this point, since the first data voltage VDATA_OD is greater than the voltage stored in the first capacitor, the eighth transistor T8 may be turned off. When the eighth transistor T8 is turned off, the first data voltage VDATA_OD may be provided to the first node N1. In this case, the voltage stored in the first capacitor may be charged until the voltage stored in the first capacitor becomes equal to the level of the first data voltage VDATA_OD.

According to the pixel P, the first capacitor may be charged or discharged to a level of the data voltage VDATA_OD required in a current frame by using the eighth transistor T8 that is configured to receive the data voltage VDATA_OD through the gate electrode of the eighth transistor T8. In this case, since the pixel P is configured such that the gate electrode of the first transistor T1 is not initialized to the initialization voltage VI every frame, the unnecessary power consumption in the pixel P may be minimized. In addition, since the pixel P is configured such that an operation of separately initializing the gate electrode of the first transistor T1 is omitted, the display panel 100 may be driven at a high speed. In addition, the pixel P may be configured such that an over-driving data voltage VDATA_OD for which the threshold voltage of the eighth transistor T8 is compensated is applied to the gate electrode of the first transistor T1, so that the noise generation caused by the threshold voltage of the eighth transistor T8 may be prevented.

The pixel and the display device including the pixel according to embodiments may minimize the unnecessary power consumption in the pixel. In addition, the pixel and the display device including the pixel according to embodiments may drive the display panel at a high speed because the operation of separately initializing the gate electrode of the first transistor is omitted.

The foregoing is illustrative of embodiments and is not to be construed as limiting thereof. Although embodiments have been described, those skilled in the art will readily appreciate that many modifications are possible in the embodiments without materially departing from the novel teachings and advantages of the present disclosure. Accordingly, all such modifications are intended to be included within the scope of the present disclosure as defined in the claims. Therefore, it is to be understood that the foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A pixel comprising:

a first transistor including a gate electrode connected to a first node, a first electrode connected to a second node, and a second electrode connected to a third node;

a second transistor including a gate electrode configured to receive a first gate signal, a first electrode configured to receive a first data voltage, and a second electrode connected to the second node;

a third transistor including a gate electrode configured to receive the first gate signal, a first electrode connected to the first node, and a second electrode connected to the third node;

a fourth transistor including a gate electrode configured to receive the first gate signal, a first electrode connected to the first node, and a second electrode connected to a fourth node;

a fifth transistor including a gate electrode configured to receive a first emission control signal, a first electrode configured to receive a first power supply voltage, and a second electrode connected to the second node;

a sixth transistor including a gate electrode configured to receive the first emission control signal, a first electrode connected to the third node, and a second electrode connected to a fifth node;

a seventh transistor including a gate electrode configured to receive a second gate signal, a first electrode configured to receive an initialization voltage, and a second electrode connected to the fifth node;

an eighth transistor including a gate electrode configured to receive a second data voltage, a first electrode connected to the fourth node, and a second electrode configured to receive the initialization voltage;

a first capacitor including a first electrode configured to receive the first power supply voltage and a second electrode connected to the first node; and a light emitting element including a first electrode connected to the fifth node and a second electrode configured to receive a second power supply voltage.

2. The pixel of claim 1, wherein the eighth transistor is configured to adjust a voltage level of the first capacitor based on a difference between a level of a voltage stored in the first capacitor and a level of the second data voltage.

3. The pixel of claim 2, wherein the eighth transistor is configured to decrease the voltage level of the first capacitor to the level of the second data voltage when the voltage stored in the first capacitor is greater than the second data voltage.

4. The pixel of claim 2, wherein the eighth transistor is configured to increase the voltage level of the first capacitor to the level of the second data voltage when the voltage stored in the first capacitor is less than the second data voltage.

5. The pixel of claim 2, wherein the first data voltage and the second data voltage have a same level.

6. The pixel of claim 2, wherein the first data voltage and the second data voltage have mutually different levels.

7. The pixel of claim 6, wherein the second data voltage is equal to a sum of the first data voltage and a threshold voltage of the eighth transistor.

8. The pixel of claim 2, further comprising:

a ninth transistor including a gate electrode configured to receive the first gate signal, a first electrode configured to receive a data compensation voltage, and a second electrode connected to the gate electrode of the eighth transistor.

9. The pixel of claim 8, wherein the level of the second data voltage is determined according to a voltage ratio between the first data voltage and the data compensation voltage.

10. The pixel of claim 2, wherein the second data voltage is generated based on an over-driving data look-up table to compensate for a threshold voltage of the eighth transistor.

11. A display device comprising:

a display panel including a plurality of pixels; and a panel driver configured to drive the display panel, wherein each of the pixels includes:

a light emitting element;

a switching transistor to which a data voltage is applied in response to a gate signal;

a first capacitor configured to store the data voltage when the switching transistor is turned on in response to the gate signal;

a driving transistor configured to allow a driving current corresponding to the data voltage stored in the first capacitor to flow to the light emitting element; and a voltage control transistor configured to receive the data voltage through a gate electrode of the voltage control transistor and to adjust a voltage level of the first capacitor based on a difference between the voltage level of the first capacitor and a level of the data voltage received through the gate electrode.

12. The display device of claim 11, wherein the data voltage applied to the switching transistor is a first data voltage, and the data voltage received through the gate electrode of the voltage control transistor is a second data voltage.

13. The display device of claim 12, wherein the voltage control transistor is configured to decrease the voltage level of the first capacitor to a level of the second data voltage when the voltage stored in the first capacitor is greater than the second data voltage.

14. The display device of claim 12, wherein the voltage control transistor is configured to increase the voltage level of the first capacitor to a level of the second data voltage when the voltage stored in the first capacitor is less than the second data voltage.

15. The display device of claim 12, wherein the first data voltage and the second data voltage have a same level.

16. The display device of claim 12, wherein the first data voltage and the second data voltage have mutually different levels.

17. The display device of claim 16, wherein the second data voltage is equal to a sum of the first data voltage and a threshold voltage of the voltage control transistor.

18. The display device of claim 12, further comprising:

a compensation transistor including a gate electrode configured to receive the gate signal, a first electrode configured to receive a data compensation voltage, and a second electrode connected to the gate electrode of the voltage control transistor.

19. The display device of claim 18, wherein a level of the second data voltage is determined according to a voltage ratio between the first data voltage and the data compensation voltage.

20. The display device of claim 12, wherein the second data voltage is generated based on an over-driving data look-up table to compensate for a threshold voltage of the voltage control transistor.

* * * * *